United States Patent [19]

Moriya et al.

[11] 4,403,741

[45] Sep. 13, 1983

[54] ELECTROMAGNETIC FUEL INJECTION VALVE

[75] Inventors: Hisanori Moriya; Masakichi Momono; Masahiro Souma; Masami Nagano, all of Katsuta, Japan

[73] Assignee: Hitachi, Ltd., Tokyo, Japan

[21] Appl. No.: 229,839

[22] Filed: Jan. 30, 1981

[30] Foreign Application Priority Data

Jan. 30, 1980 [JP] Japan ..... 55-10749

[51] Int. Cl.[3] ..... B05B 1/30

[52] U.S. Cl. ..... 239/585

[58] Field of Search ..... 239/585, 533.2–533.12; 251/139, 140

[56] References Cited

U.S. PATENT DOCUMENTS 3,721,390 3/1973 Jackson ..... 239/585
3,731,880 5/1973 Williams ..... 239/585
4,101,074 7/1978 Kiwior ..... 239/585
4,186,883 2/1980 Robling ..... 239/491
4,264,040 4/1981 Saito ..... 239/585

*Primary Examiner*—Andres Kashnikow
*Assistant Examiner*—Gene A. Church
*Attorney, Agent, or Firm*—Antonelli, Terry & Wands

[57] ABSTRACT

An electromagnetic fuel injection valve including a valve seat of the conical shape located at one end of a fuel injection passage, movable valve means including a ball cooperating with the valve seat of the conical shape, a rod rigidly connected to the ball and a plunger rigidly connected to the rod, and an electromagnet for moving the plunger. The movable valve means is guided during the movement thereof in an axial direction in two positions, one position being on the outer periphery of the ball and the other position being on the outer periphery of the rod.

6 Claims, 2 Drawing Figures

ELECTROMAGNETIC FUEL INJECTION VALVE

BACKGROUND OF THE INVENTION

1. Field of the Invention

This invention relates to electromagnetic fuel injection valves, and more particularly it is concerned with an electromagnetic fuel injection valve suitable for use with an internal combustion engine.

2. Description of the Prior Art

An electronic fuel injection system generally includes an electromagnetic fuel injection valve built in a suction section of each cylinder of the engine, and a fuel pressurized to a predetermined level is fed to each fuel injection valve. In operation, a current of a pulse duration commensurate with the volume of air intake is passed to the injection valves to open same to allow the fuel to be injected therethrough during the corresponding period of time.

Needle valves are used in the majority of the electromagnetic injection valves of the prior art. To obtain complete fuel cutoff while the injection valves in the form of needle valves are closed requires movement of the needle valves with the axis of each valve being accurately in alignment with the axis of the associated valve seat. To this end, it has hitherto been customary to use needle valves of an increased length to enable the needle valves to be guided at axially spaced-apart two points by guide means. This type of needle valves and guide means require high precision finishes, causing the fuel injection valves to become expensive and the weight of the needle valves to be increased.

In order to reduce the cost of fuel injection systems, there is nowadays a tendency to adopt, instead of the system in which one fuel injection valve is mounted in each cylinder of the engine, a single injection system in which only one injection valve is used and a mixture of air with the injected fuel is distributed to all the cylinders through a manifold. In the single injection system, it is necessary to obtain fuel injection in synchronism with the feeding of air to all the cylinders by using one electromagnetic valve. This makes it necessary for the fuel injection valve to operate at higher speed than fuel injection valves of the system in which one fuel injection valve is provided to each cylinder. Electromagnetic valves of the prior art have found to be handicapped in meeting the requirements of operating at higher speeds because of their heavy weight.

A fuel injection valve in the form of a ball valve is known as from U.S. Pat. No. 3,731,880. This U.S. patent discloses a fuel injection valve including a spring biased magnetic ball which oscillates with respect to a conical valve seat, to open the valve by the attracting force of an electromagnet. In this type of fuel injection valve, the ball itself cooperates with the electromagnetic to constitute a magnetic circuit. Because of this arrangement, the ball would have a large amount of leakage flux, making it impossible to obtain a high attracting force. The result of this would be that the ball could not be forced against the conical valve seat with enough force to prevent imperfect sealing.

SUMMARY OF THE INVENTION

Accordingly, a main object of this invention is to provide an electromagnetic fuel injection valve having a movable valve part of reduced weight suitable to obtain high-speed operation of the valve while eliminating the need to provide high precision finishes as required in electromagnetic fuel injection valves of the prior art.

Another object is to provide an electromagnetic fuel injection valve in which stable operation of the movable parts is ensured in addition to the provision of positive seal to the valve.

Additional and other objects, features and advantages of the invention will become apparent from the description set forth hereinafter when considered in conjunction with the accompanying drawings.

DETAILED DESCRIPTION OF THE PREFERRED EMBODIMENT

Figure 1:
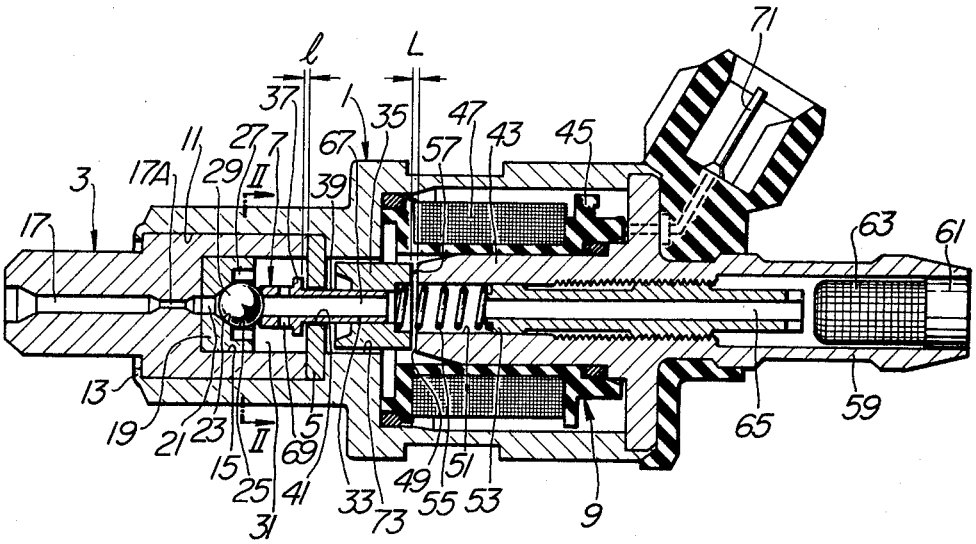
FIG. 1 is a sectional view of the electromagnetic fuel injection valve comprising a preferred embodiment of the invention.
Figure 2:
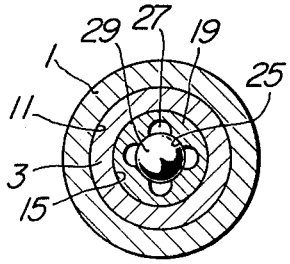
FIG. 2 is a view of the valve as seen in the direction of arrows II—II in FIG. 1.

The embodiment of the electromagnetic fuel injection valve in conformity with the invention comprises a cylindrical main body case 1 having mounted therein a nozzle 3, a guide 5, movable valve means 7 and an electromagnet 9 arranged in alignment with one another. The nozzle 3 and guide 5 are inserted in a bore 11 formed in a left end portion (see FIG. 1) of the case 1 whose left edge 13 is deformed radially inwardly after the guide 5 and nozzle 3 are inserted in the bore 11, to secure them in place.

The nozzle 3 is formed with a recess 15 of large diameter at its inner end portion and a fuel injection passage 17 extending axially of the nozzle 3 and including a reduced diameter portion disposed midway therein to provide a metering orifice 17A. Force fitted and held in place in the recess 15 is a valve seat memer 19 which is formed with a port 21 communicating with the fuel injection passage 17, a conical valve seat 23, a cylindrical guide surface 25 extending from an outer end of the valve seat 23 and grooves 27 formed on the guide surface 25 and extending axially thereof.

The movable valve means 7 includes a ball 29 supported by the cylindrical guide surface 25 for axial movement. The ball 29 cooperates with the valve seat 23 to bring the fuel injection passage 17 into and out of communication with a space 31. The movable valve means 7 further includes a hollow rod 33 and a plunger 35. The rod 33 has the ball 29 joined as by welding to one end (the left end as shown) thereof, and the plunger 35 is rigidly connected to the other end or right end thereof. Thus the ball 29, rod 33 and plunger 35 are unitary in structure and operate as a unit. The rod 33 is formed at its outer periphery with a flange 37 and a cylindrical guide surface 39 which is slidable fitted in a guide opening 41 formed in the center of the guide 5. The flange 37 abuts against the guide 5 when the movable valve means 7 is attracted to the electromagnet 9 and moves rightwardly, to prevent further movement of the movable valve means 7.

The electromagnet 9 includes a hollow core 43, a bobbin 45 located on the outer periphery of the core 43 and a coil 47. The core 43 has an inner end extending to the vicinity of the plunger 35, and the main body case 1, plunger 35 and core 43 constitute a magnetic circuit. The core 43 includes a bore 51 having a hollow spring stopper 53 threadably fitted therein and having connected thereto one end of a coil spring 55 which is forced at the other end thereof against the plunger 35, to thereby move the movable valve means 7 to a closing position in which the ball is forced against the valve seat 23. The biasing force of the spring 55 can be adjusted by means of the stopper 53. When the movable valve means 7 is in the closing position shown in FIG. 1, a very small gap 57 of a distance L is defined between the core 43 and plunger 35, and a very small gap of a distance l is defined between the guide 5 and the flange 37 of rod 33. The distance L is selected such that it is slightly larger than the distance l or larger by 0.05 mm, for example. Thus when the movable valve means 7 is attracted to the core 43, there is remained a small air gap of 0.05 mm between the end of the plunger 35 and the end of the core 43. The presence of the air gap prevents a delay in the action of the movable valve means 7 when the valve is closed that might otherwise occur due to a residual magnetic flux.

The core 43 is formed at its right end with a connector pipe 59 defining a fuel inlet passage 61, which is integral with the core 43 and adapted to be connected to an external fuel supply source. The fuel inlet passage 61 having a filter 63 mounted therein communicates with the space 31 via a bore 65 formed in the spring stopper 53, a bore 67 formed in the rod 33 and radial openings 69. The numeral 71 designates a terminal connected to the coil 47.

In operation, a fuel of a predetermined pressure is supplied to the space 31 via the bores 65 and 67 and openings 69 from the fuel inlet passage 61. When no current is passed to the coil 47, the movable valve means 7 is moved by the biasing force of the coil spring 55 to a valve closing position and held therein. Upon an energizing current being passed to the coil 47, the plunger 35 is attracted toward the core 43 against the biasing force of the spring 55 and the movable valve means 7 is moved to a valve opening position, thereby allowing the fuel to be injected through the grooves 27, metering orifice 17A and passage 17. Upon the energizing current flowing to the coil 47 being cut off, the movable valve means 7 is restored to the valve closing position by the biasing force of the coil spring 55, to interrupt the injection of the fuel.

As described hereinabove, the movable valve means 7 has the outer periphery of the ball 29 guided by the cylindrical guide surface 25 and the outer periphery of the rod 33 guided by the guide opening 41 of the guide 5. Stated differently, the movable valve means 7 is guided at two axially spaced positions. Thus the movable valve means 7 is moved in reciprocatory movement while its axis is kept in alignment with the axes of the conical valve seat 23 and the electromagnet 9. This means that the ball 29 moves on the axis of the conical valve seat 23, so that the ball covers the minimum distance in moving from the valve opening position to the valve closing position. Thus the valve can be closed at high speed. By using a ball as the valve body adapted to come into engagement with the conical valve seat 23, it is possible to provide a positive seal when the valve is closed even if the axis of the movable valve means 7 is slightly inclined. This permits a larger clearance to be provided to the guide portions of the movable valve means 7 and a smaller distance to be provided between the guide portions, than in needle valves of the prior art. In needle valves of the prior art, the clearance around the guide portions is about 5$\mu$ and the distance between the guide portions is about 11 mm. In the embodiment of the invention shown and described hereinabove, the clearance around the guide portions (the outer periphery of the ball 29 and the outer periphery or the rod 33) is in the range between 10 and 40$\mu$ and the distance between the guide portions is about 7 mm. This is conducive to a reduction in the weight of the needle valve and a reduction in production cost because the weight of the movable valve means 7 is reduced. The use of the plunger 35 attracted to the electromagnet 9 permits a higher attracting force to be utilized than in electromagnetic fuel injection valves of the prior art in which the ball is directly attracted to the electromagnet. As a result, the biasing force of the coil spring 55 can be increased to enhance the pressure at which the ball 29 engages the valve seat 23. The arrangement whereby the direction of movement of the plunger 35 is in alignment with the axis of the electromagnet 9 is conducive to the stabilization of the operation of the plunger 35, because the latter is not attracted to an inner wall surface 73 of the case 1 and the axis of the plunger 35 is not inclined during the operation of the electromagnet 9. Thus the embodiment of the electromagnetic fuel injection valve in conformity with the invention is capable of operating at high speed in a stable manner and providing a seal when brought to a closed position.

While the described embodiment represents the preferred form of the present invention, it is to be understood that modifications will occur to those skilled in the art without departing from the spirit of the invention. The scope of the invention is therefore to be determined solely by the appended claims.

What is claimed is:

1. An electromagnetic fuel injection valve comprising:

a main body case of the cylindrical shape;

nozzle means located at one end of said main body case and including a fuel injection passage and a valve seat of a conical shape formed at an inner end of said fuel injection passage;

an electromagnet located at the other end of said main body case in alignment with said valve seat of conical shape, said electromagnet including a core and an electromagnetic coil located around said core;

movable valve means located midway between an inner end of said core and said valve seat of conical shape substantially in alignment with said valve seat and said core, said movable valve means including a plunger disposed adjacent said core and cooperating with the core to form a magnetic circuit, a ball adapted to be brought into and out of engagement with said valve seat of conical shape, and a rod having said plunger and said ball secured to opposite ends thereof;

spring means normally urging said movable valve means into engagement with said valve seat of concial shape by its biasing force;

first guide means for physically guiding the outer periphery of said ball; and second guide means for physically guiding the outer periphery of said rod to enable said movable valve means to move axially thereof.

2. An electromagnetic fuel injection valve as set forth in claim 1, further comprising stopper means providing a very small gap between said plunger and said core when said electromagnet is energized and said plunger is attracted to said electromagnet.

3. An electromagnetic fuel injection valve as set forth in claim 2, wherein said stopper means comprises a flange formed at the outer periphery of said rod and projecting outwardly therefrom, said flange being located such that when said movable valve means moves toward said electromagnet, said flange abuts against said second guide means.

4. An electromagnetic fuel injection valve as set forth in claim 1, 2 or 3, wherein said first guide means comprises a cylindrical inner surface extending from the outer periphery of said valve seat of the conical shape, and at least one groove formed on said cylindrical inner surface and extending axially thereof.

5. An electromagnetic fuel injection valve as set forth in claim 1, wherein said rod is slideably mounted for reciprocation relative to said second guide means and is of a rigid construction so as not to flex in use, whereby said ball is maintained in axial alignment with the axes of the conical valve seat and electromagnet.

6. An electromagnetic fuel injection valve as set forth in claim 1 or 5, wherein said rod is a hollow tube having a fuel flow passage therethrough.

* * * * *